United States Patent [19]

Mathe et al.

[11] Patent Number: 4,778,574

[45] Date of Patent: Oct. 18, 1988

[54] AMINE-CONTAINING BATH FOR ELECTROPLATING PALLADIUM

[75] Inventors: Zoltan F. Mathe, Easton; Augustus Fletcher, Bristol, both of Conn.

[73] Assignee: American Chemical & Refining Company, Inc., Waterbury, Conn.

[21] Appl. No.: 95,889

[22] Filed: Sep. 14, 1987

[51] Int. Cl.[4] ..... C25D 3/52

[52] U.S. Cl. ..... 204/47

[58] Field of Search ..... 204/47, 44.6

[56] References Cited

U.S. PATENT DOCUMENTS

| | | | |
|---|---|---|---|
| 543,824 | 7/1895 | Altman | 204/44.6 |
| 1,981,715 | 11/1934 | Atkinson | 204/1 |
| 2,452,308 | 10/1948 | Lambros | 204/47 |
| 3,458,409 | 7/1969 | Hayashi et al. | 204/43 |
| 3,530,050 | 9/1970 | Ickenham | 204/47 |
| 3,580,820 | 5/1971 | Yamamura et al. | 204/43 |
| 3,677,909 | 7/1972 | Yamamura et al. | 204/43 |
| 3,925,170 | 12/1975 | Skomoroski | 204/43 |
| 3,933,602 | 1/1976 | Henzi et al. | 204/44 |
| 3,972,787 | 8/1976 | Nobel et al. | 204/47 |
| 4,076,599 | 2/1978 | Caricchio, Jr. et al. | 204/47 |
| 4,100,039 | 7/1978 | Carcchio, Jr. et al. | 204/43 N |
| 4,144,141 | 3/1979 | Schuster | 204/47 |
| 4,242,180 | 12/1980 | Heppner et al. | 204/43 N |
| 4,297,177 | 10/1981 | Fletcher et al. | 204/43 N |
| 4,297,179 | 10/1981 | Skomoroski | 204/47 |
| 4,299,672 | 11/1981 | Ehrich et al. | 204/43 N |
| 4,406,755 | 9/1983 | Morrissey | 204/47 |
| 4,416,740 | 11/1983 | Schulze-Berge | 204/43 N |
| 4,428,802 | 1/1984 | Kanai et al. | 204/43 N |
| 4,465,563 | 8/1984 | Nobel | 204/43 N |
| 4,468,296 | 8/1984 | Abys et al. | 204/47 |
| 4,486,274 | 12/1984 | Abys et al. | 204/44 |
| 4,487,665 | 12/1984 | Miscioscio et al. | 204/47 |
| 4,564,426 | 1/1986 | Henning et al. | 204/44.6 |

FOREIGN PATENT DOCUMENTS

| | | | |
|---|---|---|---|
| 958685 | 5/1964 | United Kingdom | 204/47 |

*Primary Examiner*—G. L. Kaplan

[57] ABSTRACT

A bath for electroplating palladium employs a combination of an aliphatic amine compound and an alicyclic amine compound as metal ion complexing agents.

16 Claims, No Drawings

AMINE-CONTAINING BATH FOR ELECTROPLATING PALLADIUM

BACKGROUND OF THE INVENTION

Because of the outstanding electrical characteristics, hardness, contact and corrosion resistances, stability and other desirable properties exhibited by palladium, it is advantageously used as a plating for electrical connectors, printed circuits, and the like, as well as for numerous other industrial and commercial applications. As a substitute for gold and platinum, palladium represents a more economical alternative, both on a simple weight basis and also in terms of covering power, due to its lower density; alloys of palladium, and especially with nickel, have been used in certain applications in order to further reduce costs.

Electroplating baths presently used for producing palladium and palladium alloy deposits typically operate at high alkaline pH values (e.g., 9 to 10) and at relatively high temperatures (e.g., 60° Centigrade), and they commonly contain ammonia as a complexing agent. A disadvantage of using free ammonia is that it must be added constantly, to compensate for evaporation so as to maintain the desired pH, which otherwise tends to drift downwardly during operation; at pH values below about 7.5 or 8 the solubility of certain constituents decreases to the extent that precipitation becomes problematic. The constant ammonia demand, however, makes maintenance of the bath time-consuming, inconvenient, and expensive; in addition, the toxicity of ammonia gas imposes stringent venting requirements, to maintain a safe and pleasant environment.

The prior art has proposed a wide variety of formulations for producing deposits of palladium and its alloys upon workpieces. The following patents (which are, except where indicated, of the U.S.) are exemplary:

Altman U.S. Pat. No. 543,824 provides an electrolytic bath for depositing alloys of platinum and nickel, which purports to contain ethylamine or any other suitable organic base containing nitrogen; methylamine and pyridine are specifically mentioned. The patent suggests addition of the nickel as its ammonium sulfate salt, and evidently the bath contains no free ammonia.

U.S. Pat. No. 1,981,715, to Atkinson, discloses a process for electroplating palladium and its alloys, utilizing a catholyte containing an ammoniacal solution of the metal to be deposited. It is disclosed that organic amines, such as pyridine and ethylenediamine, can be used instead of ammonia to form the desired palladium ammino compounds.

Lambrose U.S. Pat. No. 2,452,308 teaches electroplating palladium from a cyanide solution.

In accordance with Hayashi et al U.S. Pat. No. 3,458,409, palladium is electroplated from an ammoniacal solution containing, as a brightening agent, pyridine, pyridine carboxylic acid or pyridine carboxylic acid amine.

The inclusion of ammonium sulfamate in a palladium plating bath is disclosed in Ickenham U.S. Pat. No. 3,530,050.

Sodium 1,3,6-naphthalenetrisulfonate is utilized, in accordance with Yamamura U.S. Pat. No. 3,580,820, as a brightener for palladium/nickel plating from an ammoniacal solution; aromatic sulfonamides, such as saccharin, are also taught. Yamamura et al U.S. Pat. No. 3,677,909 contains similar disclosure.

Skomoroski et al U.S. Pat. No. 3,925,170 provides a composition for palladium electroplating, which may include ammonium sulfamate.

Sulfite-containing baths for the electrodeposition of palladium and its alloys, which operate at a pH on the alkaline side, are taught in Henzi et al U.S. Pat. No. 3,933,602.

Nobel et al U.S. Pat. No. 3,972,787 utilizes water-soluble quaterinized pyridine salts in baths for electroplating palladium.

Compositions for palladium electrodeposition are provided by Carricchio, Jr. et al U.S. Pat. No. 4,076,599, which contain palladosammine chloride, ammonium sulfamate and an alkali metal sulfite, in addition to ammonium chloride and ammonium hydroxide. A similar bath, used for producing a palladium/nickel alloy deposit, is disclosed in Carricchio, Jr. et al U.S. Pat. No. 4,100,039, wherein the nickel may be supplied as the sulfamate, chloride or sulfate salt.

Ammonia-free palladium baths are taught in Schuster et al U.S. Pat. No. 4,144,141, wherein aminoacetic acid is utilized as a complexing agent. Similar disclosure is found in Heppner et al U.S. Pat. No. 4,242,180.

Ammonium sulfamate-containing electrolytes for palladium electroplating are taught in U.S. Pat. Nos. 4,297,177 and 4,297,179, to Fletcher et al and Skomoroski, respectively; the former discloses the incorporation of saccharin.

Ehrich et al U.S. Pat. No. 4,299,672 provides a bath and process for the galvanic separation of palladium/-nickel alloys, in which aliphatic amines, preferably containing as many as six amino groups in a carbon chain of up to eight carbon atoms, are utilized as sequestering agents; specific compounds employed include acids, such as glycine, and polyfunctional amine compounds.

Schulze-Berge U.S. Pat. No. 4,416,740 teaches the use of salts of naphthalene sulfonic acid and aromatic sulfonamides in baths for plating palladium/nickel alloys; brightness and mechanical properties of the coating are improved by the addition of one, or preferably more, acetylene amines and acetylene amino alcohols.

A palladium/nickel alloy electroplating solution is provided by Kanai et al U.S. Pat. No. 4,428,820, which contains ammonium nickel sulfate and tetramminepalladous chloride.

Organosulfonic acids are employed, in accordance with Nobel U.S. Pat. No. 4,465,563, for the electrodeposition of palladium/silver alloys.

Palladium ammine hydroxide is employed by Abys et al U.S. Pat. No. 4,468,296 in an electroplating process, and certain aliphatic polyamine complexes are employed in the palladium plating procedure of Abys et al U.S. Pat. No. 4,486,274.

White deposits of palladium are produced in accordance with Miscioscio et al U.S. Pat. No. 4,487,665 by use of an electroplating bath containing palladosammine chloride, ammonium sulfate and a brightener such as saccharin; potassium chloride may also be incorporated, and small amounts of nickel sulfate may be utilized as a brightener.

In accordance with Henning et al U.S. Pat. No. 4,564,426, palladium/nickel alloy is electroplated from a mildly alkaline bath containing palladosammine chloride, nickel ion, ammonium sulfate, ammonium chloride and ammonium hydroxide.

A "faintly ammoniacal" electroplating bath for the deposition of palladium is provided by Miles United Kingdom patent No. 958,685, which includes sulfamate ions and ammonium ions and has a pH of 5 to 9.

Despite the foregoing, a demand exists for an electroplating bath, and for a method utilizing it, from which a sound and ductile deposit of palladium can be produced, and which operates without liberating free ammonia. It is therefore the broad object of the present invention to provide such a novel bath and method.

It is also an object of the invention to provide a novel bath and method having the foregoing characteristics, which are effective over a broad range of current densities and at low temperatures, to produce matte or bright deposits of high quality.

SUMMARY OF THE DISCLOSURE

It has now been found that certain of the foregoing and related objects of the invention are attained by the provision of an aqueous bath comprised of the following ingredients, expressed as gram moles per liter: 0.01 to 0.25 of palladium ion, 0.15 to 1.5 of a soluble electrolyte, 0.35 to 2.1 of an amine complexing agent consisting of at least one aliphatic amine and at least one alicyclic amine compound, and water. The aliphatic amine has the structural formula: $R_1$—NH—$R_2$, wherein $R_1$ and $R_2$ are the same or different and are selected from the class consisting of the hydrogen atom, methyl, ethyl and hydroxyethyl groups with the proviso that $R_1$ and $R_2$ are not both hydrogen. The alicyclic amine compound is selected from the group consisting of pyrrolidine, 2-methyl pyrrolidine, 3-methyl pyrrolidine and piperazine, and the aliphatic amine:alicyclic amine mole ratio is in the range of about 0.5:1 to 1.5:1. The bath has a pH of about 6.0 to 10.0, and is substantially devoid of free ammonia.

Generally, the electrolyte will be selected from the group consisting of alkali metal and ammonium sulfates, sulfamates, phosphates, nitrates, nitrites, and mixtures thereof. In the preferred embodiments, the aliphatic amine compound will be diethanolamine and the alicyclic amine will be piperazine. About 0.005 to 0.15 gram mole per liter of saccharin or a soluble saccharin as a stress reducer may be included in the bath, alone or together with about 0.001 to 0.05 gram mole per liter of at least one brightener.

Other objects are attained by the provision of an electroplating method, utilizing the aqueous solutions described at a temperature of about 32° to 60° Centigrade. A workpiece having an electrically conductive surface is immersed in the bath, and an electrical potential is applied across it and an anode, to provide a current density of about 0.05 to 25 amperes per square decimeter at the workpiece, and to thereby produce an electrodeposit of the desired thickness.

DETAILED DESCRIPTION OF THE PREFERRED EMBODIMENTS

As has been indicated hereinabove, the compositions of the present invention essentially comprise an aqueous solution of at least two different species of ammino complexes of palladium ion, and an electrolyte. One of the complexes is formed from an aliphatic amine conforming to the structural formula $R_1$—NH—$R_2$, wherein the substituents may be either hydrogen or one of the groups: methyl, ethyl or hydroxyethyl, and may be the same or different with the proviso that $R_1$ and $R_2$ are not both hydrogen; the preferred compound is diethanolamine. The other is an alicyclic amine reaction product, based upon pyrrolidine, its 2-methyl or 3-methyl derivatives, and piperazine; the latter is preferred. The amount of amine reactants included in the bath may range from about 0.35 to 2.1, and preferably about 0.35 to 1.37, gram moles per liter of solution; the aliphatic amine:alicyclic amine mole ratio will normally be within the broad range of about 0.5:1.0 to 1.5:1.0, preferably about 0.75:1.0 to 1.25:1.0, and usually the amines will be present in equimolar amounts. For satisfactory stability, the mole ratio of the alicyclic amine to palladium (as the metal) in the bath should be maintained at least at 2:1, and a ratio of 6.5:1.0 will often be found to afford maximum bath stability.

The palladium ion may be provided by any soluble palladium compound having a non-interfering anion. Salts such as palladous sulfate, palladous chloride, and palladous nitrate may be used, as may complexes such as diamminepalladium nitrite, palladosammine chloride (dichlorodiammine-palladium) or tetraminepalladium chloride; palladosammine chloride is preferred. The amount of palladium in the bath may broadly range from 0.01 to 0.25 gram mole per liter, and preferably the concentration will be within the range of 0.05 to 0.15 gram mole per liter.

The electrolyte may be provided by any one or a mixture of alkali metal and ammonium sulfates, sulfamates, phosphates, nitrates and nitrites; however, ammonium sulfamate is the preferred electrolyte. While it can be used in any effective concentration, generally at least 0.15, and not more than 1.5, gram moles per liter will be present, and about 0.25 to 0.75 gram mole per liter will generally afford optimal results.

The piperazine or diethanolamine will normally cause the bath to have a pH on the alkaline side. In the event that it is to be adjusted downwardly, an acid having non-interfering anion should be employed; hydrochloric will generally be preferred, but nitric, sulfuric, sulfamic and other acids, as well as mixtures thereof, may be used to advantage. The pH of the bath will be maintained within the broad range of about 6.0 to 10.0, and preferably within the range of about 6.5 to 7.5; the optimal value of pH appears to be slightly acidic, e.g., at about 6.8, for many applications.

As has been indicated above, when a brightener is employed in the bath it will usually be added in such amounts as will furnish about 0.001 to 0.05, and preferably about 0.01 to 0.04, gram mole per liter of solution. Suitable brighteners include sodium sulfite, naphthalene trisulfonic acid and benzene sulfonic acid (the sulfonic acid compounds being preferred) used individually or in various combinations; other known brighteners, such as 3-butyne-2-ol and small amounts of dissolved metals, may also be employed.

The bath will normally include a stress-reducing agent, such as saccharin or (for greater solubility) a soluble saccharin compound (e.g., sodium saccharin). Typically, the amount of this constituent will be about 0.005 to 0.15, and preferably about 0.015 to 0.05, gram mole per liter.

The operating temperature for the bath should be within the range of 32° to 60° Centigrade, and temperatures of 45° and above will generally produce the best results; a bath density of about 4° to 20° Baume will be the norm. Agitation has been found to be desirable in certain instances, in which case movement of both the solution and the workpiece will often be most advantageous. Filtration will significantly promote the production of pore-free adherent deposits, because of the profound effect that the presence of any solid contaminants can have, and is therefore a highly desirable practice. Standard filter cartridges of polypropylene or other filter media may advantageously be employed for continuous filtration.

Various anodes that are inert to the plating bath may be used, and will generally have a surface of noble metal, although carbon anodes may have limited utility. The preferred anodes are of platinum-clad tantalum, but gold-clad tantalum, platinum and palladium electrodes may all be employed effectively. The anode to cathode surface area ratio should be from about 1.0 to 5.0:1.0, and preferably a ratio of about 2.0:1.0 will be used. The baths of the invention are operable at current density values within the range of 0.05 to 25.0 amperes per square decimeter, but preferably they will be used at about 0.05 to 4.0 amperes per square decimeter.

Exemplary of the efficacy of the bath and method of the present invention are the following specific examples:

EXAMPLE ONE

An aqueous bath is prepared by dissolving (with stirring, as necessary) the following ingredients in deionized water, the amounts expressed being on a per liter basis: 16 grams of palladosammine chloride, 42 grams of piperazine, 50 milliliters of diethanolamine, 100 grams of ammonium sulfamate, and 5 grams of sodium saccharin. The resultant solution has an electrometric pH of 6.5 and a density of 8.4° Baume.

Part A

Utilizing the solution at a temperature of about 50° Centigrade, polished brass panels are electroplated in a Hull cell at a current of 1.0 ampere for a period of one minute. The deposit is grey and semi-bright over a range of about zero to 0.5 ampere per square decimeter (ASD), and on stress measurement is found to exhibit a tensile stress of 34,977 pounds per square inch. The bath operates with an efficiency of about 27 milligrams per ampere minute.

Part B

The bath is modified by the addition of 12 milliliters of a solution containing 250 grams per liter of benzene sulfonic acid, and is used in a Hull cell under the conditions described in Part A. The deposit is uniform and bright over a range of from zero to more than 2 ASD, and it has a tensile stress of 35,462 pounds per square inch; bath efficiency is about 25 milligrams per ampere minute.

EXAMPLE TWO

Part A

A bath embodying the invention is prepared by dissolving, in deionized water, the following ingredients, concentrations again being expressed on a per liter basis: 16 grams palladosammine chloride, 42.5 grams piperazine, 50 milliliters diethanolamine, 100 grams ammonium sulfamate, 5 grams sodium saccharin, 5 grams ammonium sulfite, 12 milliliters of the brightener solution of Example One, Part B, and sufficient hydrochloric acid to lower the pH to 6.8 (of course, the HCL also supplies chloride ion, which contributes to brightness in the deposit and to bath conductivity). A Hull cell test is carried out at 0.5 ampere for two minutes at about 49° Centigrade and produces about 27 milligrams of deposit and a bright range of zero to above 2 ASD. Plating at 0.3 ASD for seven hours produces a smooth, pit-free adherent deposit exhibiting a Knoop (25) hardness value (i.e., using a 25 gram indenting tool) of 340.

Part B

A bath containing the same ingredients as that of Part A hereof is prepared, except that the diethanolamine is omitted and the amount of piperazine is increased to 87 grams per liter, to furnish the same molar amount of amine as is provided by the combination of alkyl and alicyclic amines present in the Part A bath. A Hull cell test carried out under the same conditions produces about 28 milligrams of deposit over a bright range of zero to about 1 ASD. In a seven-hour plating experiment, at 0.3 ASD, a white, pitted deposit, having a Knoop (25) hardness of 321, is produced.

Part C

The bath of Part A is again formulated, but with the omission of piperazine and substitution of an equimolar amount of diethanolamine, the concentration accordingly being increased to 97 milliliters per liter. The solution is unstable, a white precipitate (palladium saccharide) being produced; no meaningful data can be obtained.

EXAMPLE THREE

Phosphor bronze connector pins, previously plated with copper and cleaned, are barrel plated at 50° Centigrade using the bath of Example One, Part A. Operation is carried out at about 0.15 ASD for 18 minutes, to deposit a minimum of about 0.75 micron of palladium. Inspection shows uniform attainment of the nominal metal thickness, with perfect adhesion.

All baths described in the foregoing Examples, with the exception of Part B and C of Example Two, are stable and are capable of producing good results under production conditions.

Thus, it can be seen that the present invention provides a novel bath and method by which a workpiece can effectively be electroplated with palladium to produce a sound and ductile deposit of high quality, which may be of either matte or bright character. Operation of the bath causes no free ammonia to be liberated, and successfully occurs over a broad range of current densities, and at low temperatures.

Having thus described the invention, what is claimed is:

1. In an aqueous bath for producing an electrodeposit of palladium, the combination, expressed as gram moles per liter, comprising: 0.01 to 0.25 of palladium ion; 0.15 to 1.5 of a soluble electrolyte; and 0.35 to 2.1 of an amine complexing agent, said agent consisting of at least one aliphatic amine compound having the structural formula: $R_1$—NH—$R_2$, wherein $R_1$ and $R_2$ are the same or different and are selected from the calss consisting of the hydrogen atom, methyl, ethyl and hydroxyethyl groups, with the proviso that $R_1$ and $R_2$ are not both hydrogen, and at least one alicyclic amine compound selected from the group consisting of pyrrolidine, 2-methyl pyrolidine, 3-methyl pyrrolidine and piperazine, said aliphatic amine and alicyclic amine compounds being present in a molar ratio of about 0.5:1 to 1.5:1; and water to volume, said bath having a pH of about 6.0 to 10.0 and being substantially devoid of free ammonia.

2. The bath of claim 1 wherein said electrolyte is selected from the group consisting of alkali metal and ammonium sulfates, sulfamates, phosphates, nitrates, nitrites, and mixtures thereof.

3. The bath of Ccaim 1 wherein said aliphatic amine compound is diethanolamine and said alicyclic amine is piperazine.

4. The bath of claim 1 additionally including about 0.005 to 0.15 gram mole per liter of saccharin or a soluble saccharin as a stress reducer.

5. The bath of claim 1 additionally including about 0.001 to 0.05 gram mole per liter of at least one brightener.

6. The bath of claim 5 wherein said brightener is an ammonium or alkali metal sulfite salt, naphthalene trisulfonic acid, benzene sulfonic acid or a mixture thereof.

7. The bath of claim 6 wherein said brightener is a sulfonic acid.

8. As an aqueous bath for producing an electrodeposit of palladium, the combination of ingredients, expressed as gram moles per liter, consisting essentially of: 0.01 to 0.25 of palladium ion; 0.15 to 1.5 of diethanolamine; 0.15 to 1.5 of piperazine; 0.075 to 4.0 of an ammonium or alkali metal sulfamate compound; zero to 0.08 of saccharin or a soluble saccharin as a stress reducer; zero to 0.05 of at least one brightener; and water to volume.

9. The bath of claim 8 containing at least 0.01 gram mole per liter of said brightener, said brightener comprising a sulfonic acid compound.

10. The bath of claim 8 containing hydrochloric acid in an amount sufficient to establish a slightly acidic pH of about 6.5 in the bath.

11. A method of electroplating a workpiece with palladium including the steps:

(a) preparing an aqueous bath comprising the following ingredients, expressed in gram moles per liter: 0.01 to 0.25 of palladium ion; 0.15 to 1.5 of a soluble electrolyte; and 0.35 to 2.1 of an amine complexing agent, said agent consisting of at least one aliphatic amine compound having the structural formual $R_1$—NH—$R_2$, wherein $R_1$ and $R_2$ are the same or different and are selected from the class consisting of the hydrogen ato, methyl, ethyl and hydroxyethyl groups, with the proviso that $R_1$ and $R_2$ are not both hydrogen and at least one alicyclic amine compound selected from the group consisting of pyrrolidine, 2-methyl pyrrolidine, 3-methyl pyrrolidine and piperazine, said aliphatic amine and alicyclic amine compounds being present in a mole ratio of about 0.5:1 to 1.5:1; and water to volume, said bath having a pH of about 6.0 to 10.0 and being substantially devoid of free ammonia;

(b) immersing a workpiece having an electrically conductive surface in said aqueous bath;

(c) maintaining the temperature of said bath of about 32° to 60° Centigrade;

(d) applying an electrical potential across said workpiece and an anode to provide a current density of about 0.05 to 25 amperes per square decimeter at said workpiece to effect electroplating of the desired thickness for the deposit; and (e) removing the electroplated workpiece from said bath.

12. The method of claim 11 wherein said electrolyte is selected from the group consisting of alkali metal and ammonium sulfates, sulfamates, phosphates, nitrates, nitrites, and mixtures thereof.

13. The method of claim 12 wherein said aliphatic amine compound is diethanolamine and said alicyclic amine is piperazine.

14. The method of claim 12 additionally including about 0.005 to 0.15 gram mole per liter of saccharin or a soluble saccharin as a stress reducer, and about 0.001 to 0.05 gram mole per liter of at least one brightener.

15. The method of claim 14 wherein said brightener is an ammonium or alkali metal sulfite salt, naphthalene trisulfonic acid, benzene sulfonic acid, or a mixture thereof.

16. The method claim 11 wherein said bath consists essentially of the following ingredients in combination, expressed as gram moles per liter: 0.01 to 0.25 of palladium ion; 0.15 to 1.5 of diethanolamine; 0.15 to 1.5 of piperazine; 0.075 to 4.0 of an ammonium or alkali metal sulfamate compound; zero to 0.08 of saccharin or a soluble saccharin as a stress reducer; zero to 0.05 of at least one brightener; zero to an amount of hydrochloric acid sufficient to establish pH in said bath of about 6.5 to 7.5, and water to volume.

* * * * *

UNITED STATES PATENT AND TRADEMARK OFFICE

CERTIFICATE OF CORRECTION

PATENT NO. : 4,778,574

DATED : Oct. 18, 1988

INVENTOR(S) : Zoltan F. Mathe and Augustus Fletcher

It is certified that error appears in the above-identified patent and that said Letters Patent is hereby corrected as shown below:

Column 6, line 56, "calss" should be -- class --,
line 62, "pyrolidine" should be -- pyrrolidine --.
Column 7, line 42, "ato" should be -- atom --.

Signed and Sealed this

Fourteenth Day of March, 1989

*Attest:*

DONALD J. QUIGG

*Attesting Officer*

*Commissioner of Patents and Trademarks*